US008764588B2

(12) United States Patent
Gill

(10) Patent No.: US 8,764,588 B2
(45) Date of Patent: Jul. 1, 2014

(54) ILLUMINATED GAME-PLAYING APPARATUSES AND GAMES

(76) Inventor: Christopher Gill, Richfield, MN (US)

( * ) Notice: Subject to any disclaimer, the term of this patent is extended or adjusted under 35 U.S.C. 154(b) by 167 days.

(21) Appl. No.: 13/571,410

(22) Filed: Aug. 10, 2012

(65) Prior Publication Data

US 2013/0040767 A1 Feb. 14, 2013

Related U.S. Application Data

(60) Provisional application No. 61/522,907, filed on Aug. 12, 2011.

(51) Int. Cl.
*A63B 67/00* (2006.01)

(52) U.S. Cl.
CPC ..... *A63B 67/00* (2013.01)
USPC ..... 473/465

(58) Field of Classification Search
USPC ..... 473/453, 468, 465; 362/295
See application file for complete search history.

(56) References Cited

U.S. PATENT DOCUMENTS

| | | | | | |
|---|---|---|---|---|---|
| 3,122,365 | A * | 2/1964 | August | 473/453 |
| D287,988 | S * | 1/1987 | Billinghurst | D21/713 |
| 4,834,376 | A * | 5/1989 | Steinberg | 473/457 |
| 4,930,776 | A * | 6/1990 | Newcomb et al. | 473/570 |
| 5,080,359 | A * | 1/1992 | Thill | 473/570 |
| 5,370,390 | A * | 12/1994 | Swanson | 473/410 |
| 5,775,800 | A * | 7/1998 | Hsieh | 362/295 |
| 6,142,894 | A * | 11/2000 | Lee | 473/570 |
| 6,464,602 | B1 * | 10/2002 | Rottger | 473/571 |
| 6,712,487 | B2 * | 3/2004 | Liou | 362/253 |
| 2003/0224885 | A1 * | 12/2003 | Leal et al. | 473/570 |
| 2009/0042658 | A1 * | 2/2009 | Suit | 473/52 |
| 2013/0040767 | A1 * | 2/2013 | Gill | 473/465 |

* cited by examiner

*Primary Examiner* — Gene Kim
*Assistant Examiner* — M Chambers
(74) *Attorney, Agent, or Firm* — Frank Marino

(57) ABSTRACT

A game-playing set including a striking device and a ball, and games for playing therewith, are disclosed. The ball includes a hollow spherical translucent outer shell and a smaller inner object loosely disposed within the outer shell. The inner object includes a first illumination element and a first inertia switch. The striking device includes a hollow translucent tube, a second illumination device rigidly disposed within the tube, and a second inertia switch. The first inertia switch is triggered by impact of the inner object against the outer shell to cause illumination of the first illumination element and the second inertia switch is triggered by an externally-applied impact against the tube to cause illumination of the second illumination element.

9 Claims, 5 Drawing Sheets

ILLUMINATED GAME-PLAYING APPARATUSES AND GAMES

RELATED APPLICATION

This application is a Continuation of and claims the benefit of U.S. Provisional Application Ser. No. 61/522,907 filed Aug. 12, 2011, the entire teachings of which are incorporated herein by reference.

FIELD OF THE INVENTION

The present invention is generally related to games and game playing. More specifically, the field of the invention as embodied in the present disclosure is related to game-playing apparatuses and sets that allow night time or low light game playing, especially (but not limited to) numerous variations and derivatives of baseball which are enabled by such game-playing apparatuses and sets.

SUMMARY OF THE INVENTION

The invention may be embodied as a game-playing apparatus or set of game-playing apparatuses that are illuminated and illuminatable in various modes, and to games which may be played therewith. More specifically, the game set may include a ball that lights up, selectively or automatically, under certain conditions or by certain actions, and one or more devices for impacting or catching the ball, which light up under the same or other conditions or actions. Even more specifically, the invention may be embodied in a baseball-type game set that includes a bat which is selectively illuminatable, and a ball that illuminates when impacted, such as by the bat. Alternatively, other illuminatable game sets and devices may be within the scope of the invention.

In one example, the invention may be embodied by or practice with a game-playing set including a striking device and a ball. The ball may include a hollow spherical translucent outer shell and a smaller inner object loosely disposed within the outer shell. The inner object may include a first illumination element and a first inertia switch. The striking device may include a hollow translucent tube, a second illumination device rigidly disposed within the tube, and a second inertia switch. The first inertia switch may be triggered by impact of the inner object against the outer shell to cause illumination of the first illumination element and the second inertia switch may be triggered by an externally-applied impact against the tube to cause illumination of the second illumination element.

The outer shell may include a plurality of through-holes spaced substantially equally there-around, each enabling direct view through the outer shell to the inner object. The tube may include a tubular wall having a wall thickness that tapers continuously from more thick adjacent the second illumination device to less thick away there-from. The tube may taper continuously from a smaller diameter adjacent the second illumination device to a larger diameter away there-from. The striking device may include an opaque tubular grip surrounding the second inertia switch.

Alternatively, the invention may be embodied by or practice with the above-described ball or the above-described striking device. The striking may further include a handle and a pommel, the pommel disposed at an end the striking device opposite from the translucent tube, and the handle connecting the translucent tube to the pommel.

Additional features and aspects of the invention are disclosed with more specificity in the description and drawings of various exemplary embodiments which follow.

BRIEF DESCRIPTION OF THE DRAWINGS

Many aspects of the invention can be better understood with reference to the following drawings showing the representative embodiment of the accompanying Detailed Description. The components in the drawings are not necessarily to scale, emphasis instead being placed upon clearly illustrating the principles of the invention. Moreover, in the drawings, like reference numerals designate corresponding parts throughout the several views.

DETAILED DESCRIPTION OF REPRESENTATIVE EMBODIMENTS

Figures 1, 2:
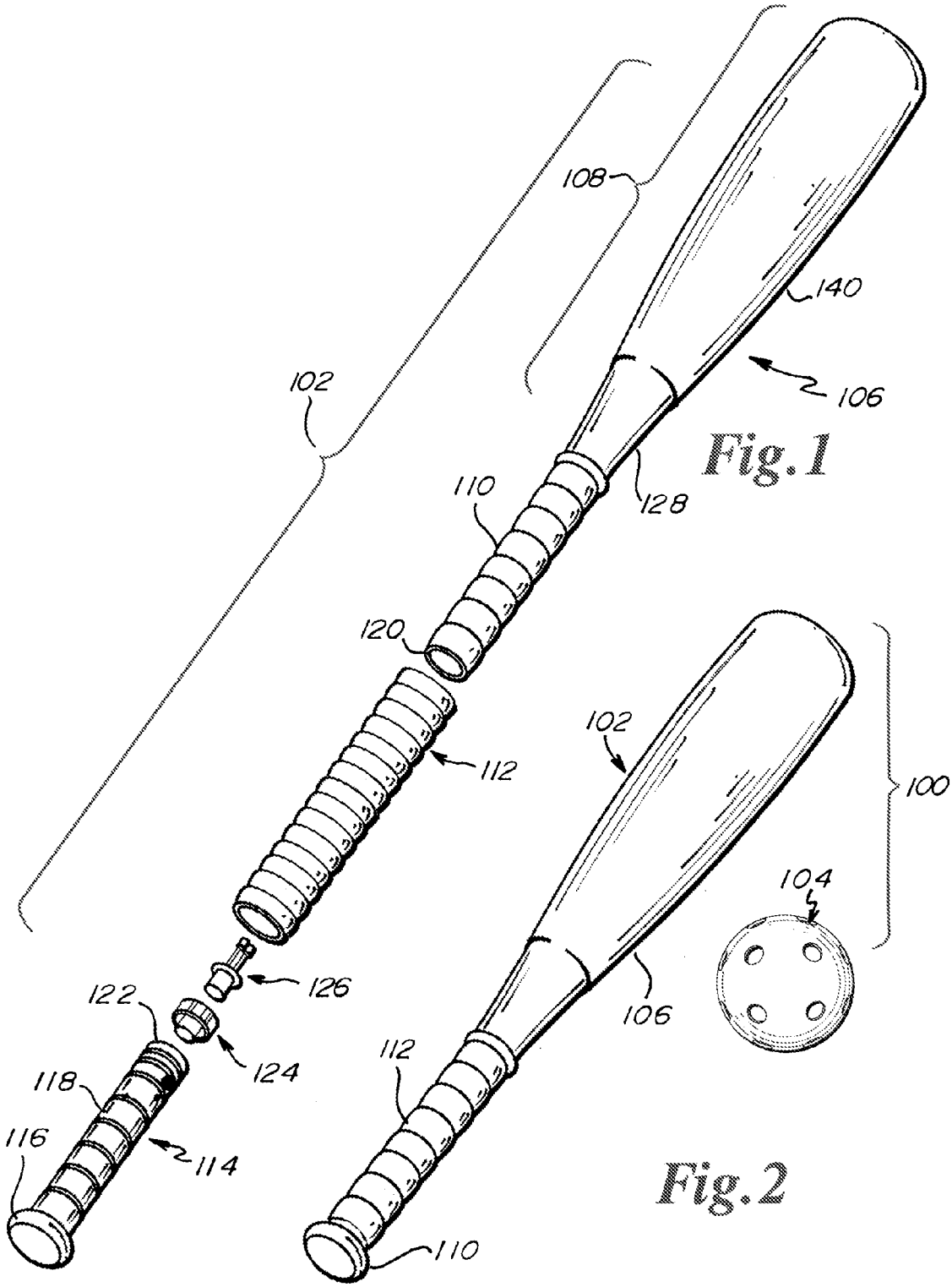
FIG. 1 is a perspective view of a bat/ball set according to and/or useful in practicing one embodiment of the invention.
FIG. 2 is an exploded view of the bat of FIG. 1.
Figure 13:
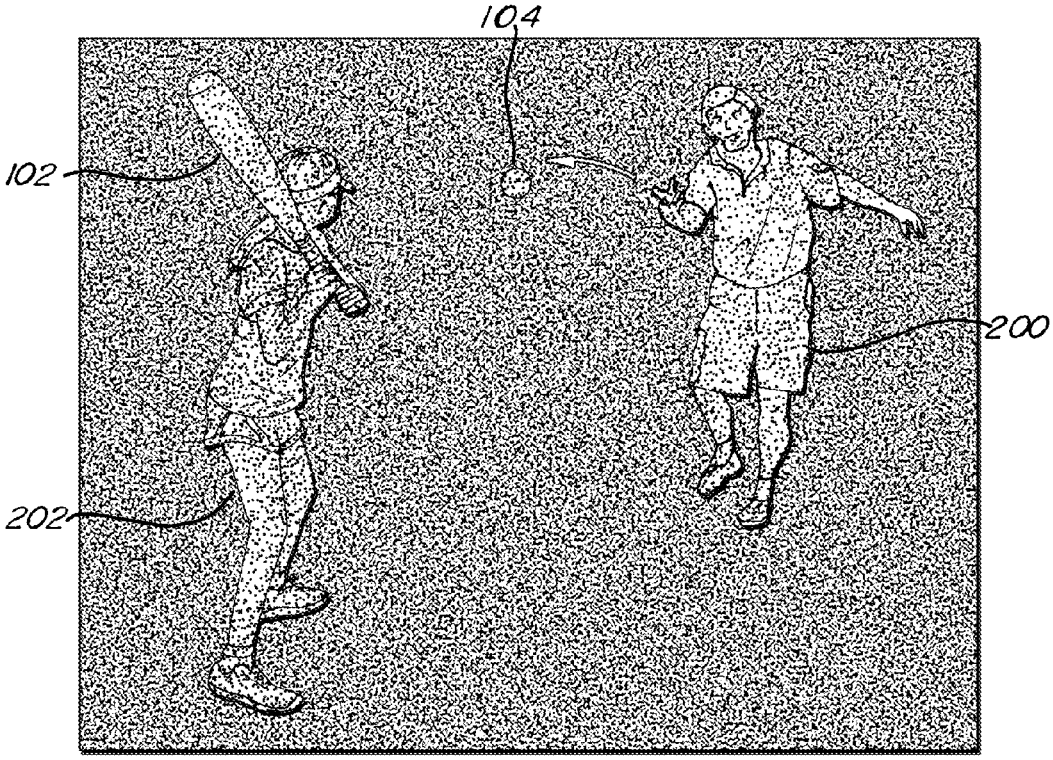
FIG. 13 is an action view of a game being played with the bat/ball set of FIG. 1 prior to illumination.
Figure 14:
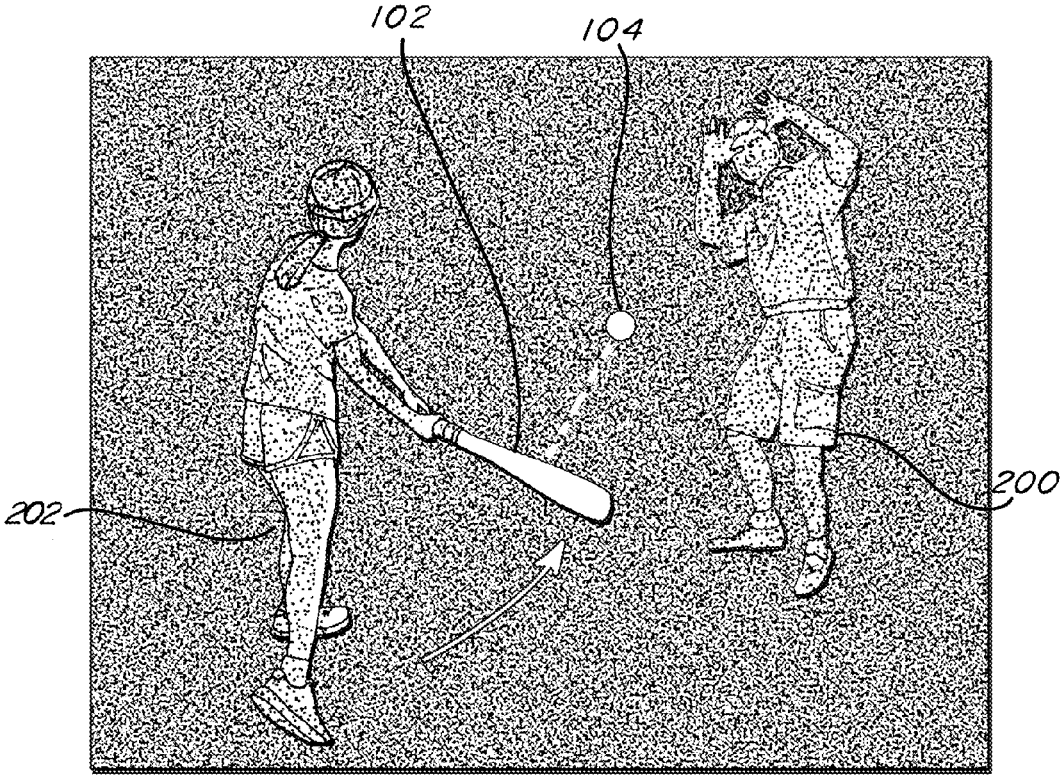
FIG. 14 is an action view of the game of FIG. 13 immediately after illumination.

The invention may be embodied in illuminated or illuminatable game-playing apparatuses, or in games using such apparatuses, FIGS. 1, 13 and 14 show a set of game-playing apparatuses in the form of an illuminatable bat/ball set 100 for use in an illuminated baseball-type game in accordance with an exemplary embodiment of the invention.

Referring first to FIG. 1, the set 100 consists of a bat 102 and a ball 104. Both consist of mainly of hollow translucent polymeric-shelled housings in accordance with prior art "wiffle type" bats and balls such as those disclosed in U.S. Pat. No. 2,776,139, the entire teachings of which are incorporated herein by reference. Wiffle® is a registered trademark of Wiffle Ball Inc. of Shelton Conn., and the applicant claims no association therewith. However, balls and bats of similar construction to those originally introduced by the '139 patent's inventor and Wiffle's founder, William Blamey Jr, have long become public domain and are referred to generically as "wiffle-type balls" and "wiffle type bats", and such language will accordingly be used throughout this specification with no intention to disparage or lessen the rights of Wiffle Ball Inc.

Referring to FIGS. 2 through 5, bat 102 consists of main housing 106 made of a hollow blow-molded elongate striking shank 108 integrally blow-molded with a hollow cylindrical hilt 110. The striking shank consists of a larger diameter tubular striking portion 140 tapering gradually down to a narrower diameter base 128 which leads into the hilt. The preferred materials of the housing are either polypropylene (PP) or high density polyethylene (HDPE).

A tubular foam-rubber grip 112 is applied permanently over the hilt to give comfort and improved gripping during use, and to hide certain of the otherwise unattractive internal elements from showing through the translucent hilt. The preferred material for the grip is ethylene vinyl acetate (EVA) foam, which is opaque.

The bat also includes handle housing 114, also hollow blow-molded of the same material as the main housing. The handle housing includes pommel 116 and tube 118. The tube is sized and shaped to be inserted into the open terminus 120 of the main housing and slid within the main housing's hilt until the pommel abuts the open terminus and grip. While the fit of the tube into the hilt is snug and the resulting assembly is firm enough to remain intact through normal play, the handle housing may be removed from the hilt with a forceful tug.

The open end 122 of the handle housing opposite the pommel is adapted to receive, by snap fit, polymeric fitting 124, into which is positioned and glued the bat's LED module 126. The fitting may be removed by prying from the handle housing, such as to service the LED module.

Figures 3, 4, 5:
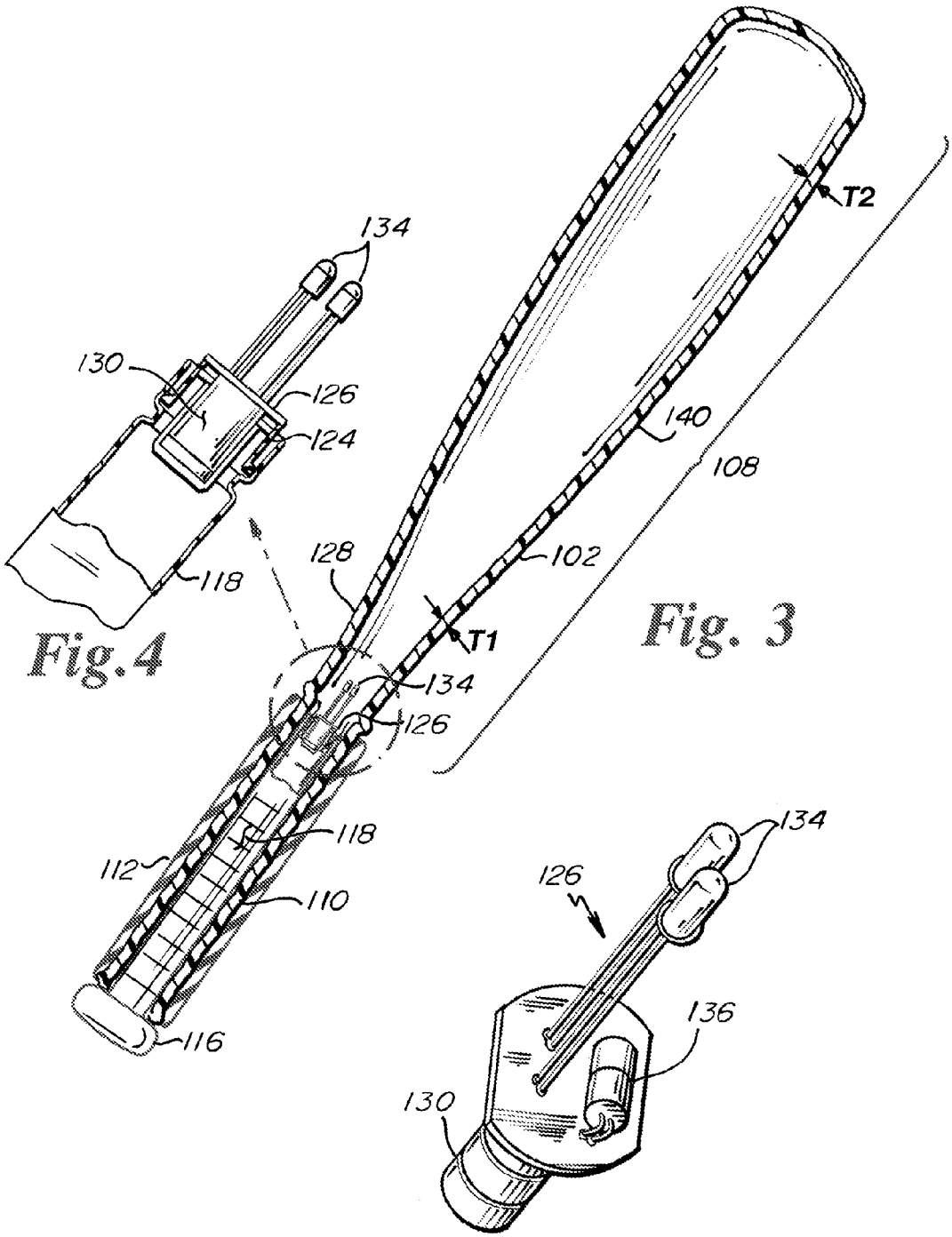
FIG. 3 is a cross-sectional view through the bat of FIG. 1.
FIG. 4 is a partial cross sectional view of the LED module of the bat of FIG. 1.
FIG. 5 is a perspective view of the LED module of FIG. 4.
Figure 6:
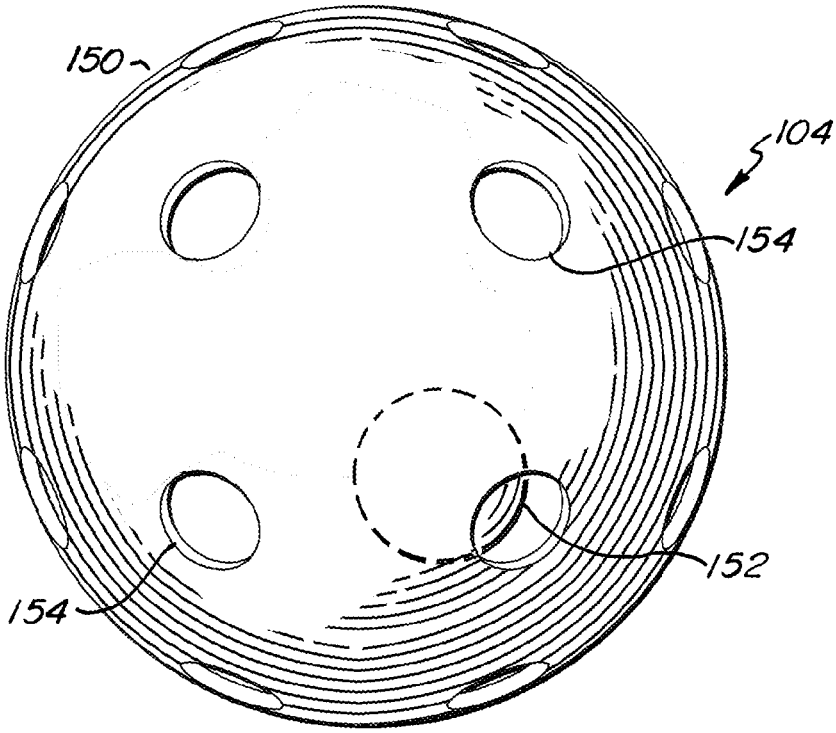
FIG. 6 is a view if the ball of FIG. 1.
Figure 7:
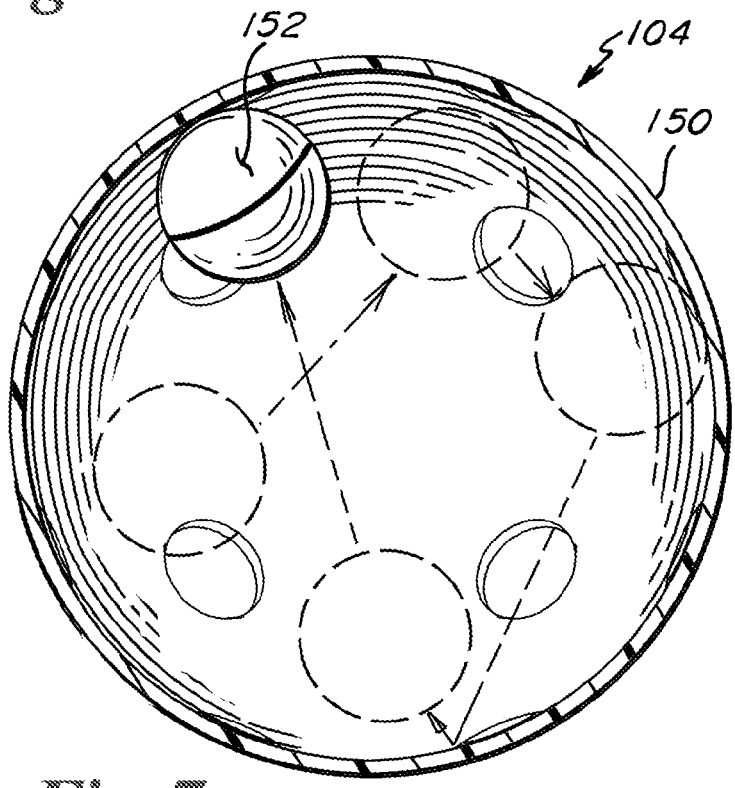
FIG. 7 is cross-sectional view of the ball of FIG. 1.
Figure 8:
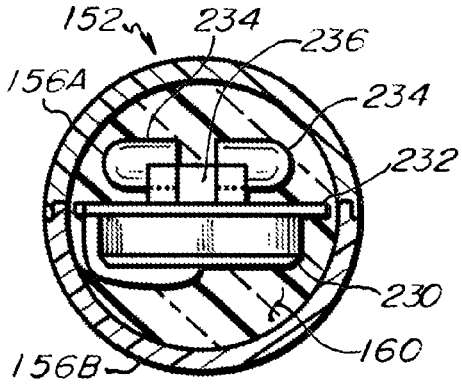
FIG. 8 is a cross-section view of the inner ball of the ball of FIG. 7.
Figure 9:
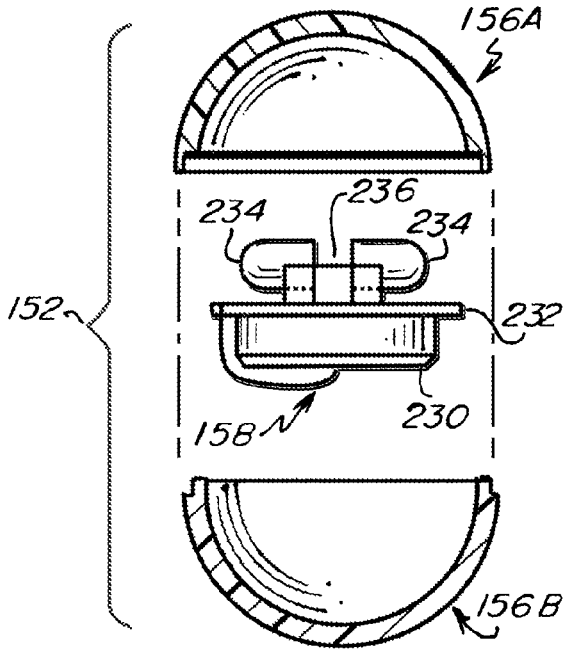
FIG. 9 is an exploded view of the inner ball of FIG. 8.

As seen best in FIG. 3, the LEDs 134 of the LED module are positioned within hollow base 128 of the translucent hollow striking shank of the main housing when the handle housing is fully inserted into the hilt. This positioning is found to not only to be optimal for activation of the LED module, but also to provide the most effective illumination, as will be further elaborated later in this disclosure.

Figure 10:
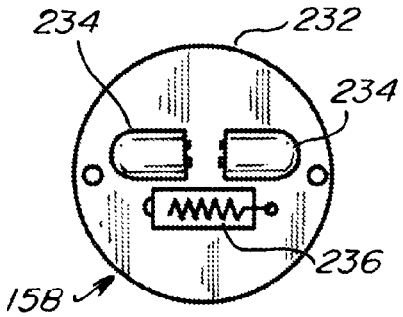
FIG. 10 is a plan view of the LED module of the inner ball of FIG. 8.

Because it surrounds the handle housing and hilt, opaque grip 112 also surrounds most of LED module 126, except the LEDs which protrude into the base of the striking shank. This prevents the unsightliness of seeing the electronics of the module through the translucent handle housing and hilt, without blocking the desirable glow from the LEDs Referring to FIGS. 5, 10, and 11, the LED module is shown in greater detail. In FIG. 5, it can be seen that the module is powered by a stack of common "button" batteries 130, mounted to the underside of PC board 132. On the tope side of the PC board are numerous electronic components, including LEDs 134, an inertia switch 136, and an IC chip 138. The circuit diagram of FIG. 12 applies to both the LED module of the bat and that of the ball, with components identified by item numbers beginning with "2" applying to ball and by item numbers beginning with "1" applying to the bat.

U.S. Pat. Nos. 6,712,487 and 7,785,215 teach impact-activated circuits which are similar to those employed herein, and use a similar inertia switch. The teachings of these patents in their entireties are incorporated herein by reference. However, the invention is not intended to be limited by this type of inertia switch, and any known inertia switch physically and electrically adaptable into the module may be substituted therefore without departing from the invention.

Because the LED module is firmly seated within the handle of the bat, striking of the bat against an object or surface will cause activation of the inertia switch, which in turn will activate a timer within the IC to energize and continuously illuminate the LEDs for thirty seconds. Such illumination of the LEDs causes the bat's translucent main housing to glow.

Due to the nature of blow-molding and the shape of the main housing's striking shank, which tapers continuously (gradually and without abrupt variation) from its wider diameter striking portion 140 to its narrower diameter base 128, the wall thickness in the striking portion is thinner than that in the base, and the wall thickness tapers continuously (gradually and without abrupt variation) inversely with the striking shank's diameter. This is found to be of surprising usefulness in concurrence with the desired illumination.

It is found that the position of the glowing LEDs cause a light piping effect with the wall of the striking shank and cause the entire shank to glow when the LEDs are illuminating. Further, the positioning of the LEDs adjacent the thicker wall T1 at the base, together with the gradual and continuous tapering down of the striking shank's wall thickness T2 toward the striking portion end of the main housing provides an almost perfectly balanced glow to the entire shank. The difference in thickness between the wall at T1 and at T2 is too fine to recognize at the scale of the drawings. While one would expect the striking shank to be brighter immediately around the LEDs, the entire shank is found to glow with virtually homogenous brightness as a result of this unique arrangement and construction.

In variations of this embodiment, the LED's may flash for the pre-programmed time, or may illuminate continuously or flash until extinguished by a second impact. The bat may also be illuminated and extinguished continuously with a manual switch rather than through an inertia switch for use in practicing certain alternate embodiments.

Referring next to FIGS. 6 through 12, ball 104 of set 100 is shown. The ball consists of hollow spherical outer shell 150 and inner ball 152. The translucent outer shell is preferable made of PP or HDPE, is of continuous wall thickness, and has an array of through-holes 154 spaced there-about. Construction of the outer shell is thereby of the previously-mentioned "waffle type", and/or in accordance with U.S. Pat. No. 2,776,139.

Excepting the lack of need for any dimples, inner ball 152 is constructed similarly to the "Light Emitting Golf Ball" of U.S. Pat. No. 6,712,487, or may be made similarly to the "Golf Ball Containing Photoluminescent Material and a Light Source" of U.S. Pat. No. 7,785,215, the entire teachings of both being incorporated herein by reference. The shape of the inner ball is not critical, and need not be spherical, also the disclosed shape is preferable.

The inner ball consists of two translucent polymeric semi-spherical shell halves 156A and 156B, LED module 158, and translucent potting medium 160. The LED module functions similarly to module 126 of bat 102, except that its time is set to cause continuous illumination for three minutes upon impact. Module 158 is shown in greater detail in FIGS. 8 though 10. The module includes LEDs 234, inertia switch 236, PC board 232, and "button" battery 230.

Figure 11:
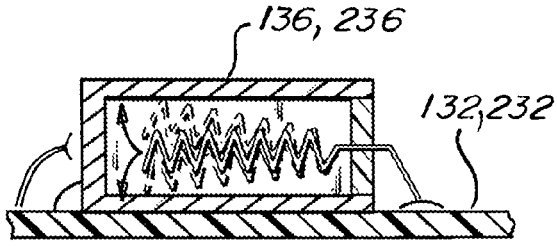
FIG. 11 is a cross sectional view through the inertia switch of the LED modules of FIGS. 4 and 10.
Figure 12:
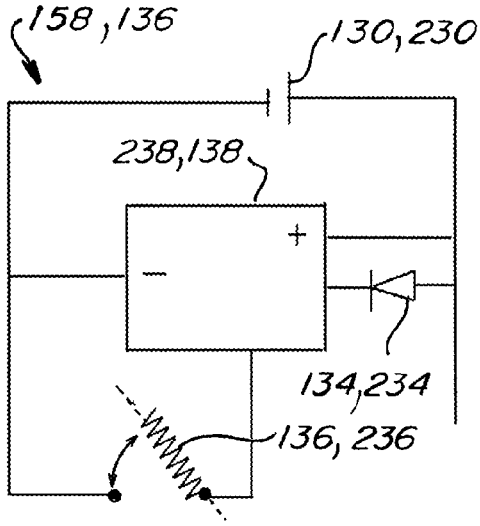
FIG. 12 is a circuit diagram for the LED modules of FIGS. 4 and 10.

FIG. 11 shows the inertia switch used in both the ball and the bat. In this figure components identified by item numbers beginning with "2" apply to ball and by item numbers beginning with "1" apply to the bat. As previously stated, the circuit diagram of FIG. 12 applies to both the LED module of the bat and that of the ball, with components identified by item numbers beginning with "2" applying to ball and by item numbers beginning with "1" applying to the bat.

At manufacturing of the inner ball, the two shell halves are partially filled with the originally gelatinous translucent potting material, preferable an epoxy-based compound, and the shell halves are then closed around the LED module. As the potting material hardens, it secures the shell halves permanently together and causes the assembly to become a single unitary structure translucent encapsulating the module visibly within. The outer shell 150 is then formed around the inner ball to capture the inner ball within its hollow center, such as by spin-welding two semi-spherical outer shell halves together.

Either a firm shaking of the assembled ball 104 or the striking of the ball by or against another surface or object will cause inner ball 152 to impact outer shell 150 and activate inertia switch 236, causing LEDs 234 to glow. While the glowing is preferably continuous and does cause translucent outer shell 150 to glow, it is found that the appearance of flashing is achieved when the ball is in flight due to the combination of the spinning of the outer shell and the occasionally direct viewing of the inner ball through through-holes 154. Whenever the inner ball becomes visible directly through the through-holes, it appears brighter, and a blinking effect is realized as the ball travels through the air, such as after having been thrown or struck with the bat.

In variations of this embodiment, the LED's may flash for the pre-programmed time, or may illuminate continuously or flash until extinguished by a second impact. The ball may also be illuminated and extinguished continuously with a manual switch rather than through an inertia switch for use in practicing certain alternate embodiment.

FIGS. 13 and 14 depict an exemplary use of the bat/ball set 100 in a nighttime baseball game. The bat 102 and ball 104 are both initially non-illuminated. The pitcher 200 then shakes the ball to cause it to become illuminated. The pitcher then pitches the illuminated ball to batter 202, as seen in FIG. 13. As the batter swings the non-illuminated bat at the ball and strikes the ball, the bat becomes illuminated, alerting fielders that contact has been made.

Rather than waiting until the bat strikes the ball, the batter may illuminate the bat prior to the pitch by striking it against the ground, to allow the pitcher to see it and know where to pitch the ball.

The bat remains illuminated for thirty seconds so that it can be easily seen by the players and cast out of the playing area while the play continues, and the ball remains lit for three minutes to be sure it is visible as it is fielded and the instant turn of play is completed.

The ball's circuitry includes a re-trigger function, wherein if it is impacted against during the three minutes that it has been lit, the three minute light-up period is started anew. The ball can thereby be lit indefinitely as long as it is being impacted at least once every three minutes.

The batteries in the ball's core, which are not replaceable, are designed to provide up to eight-hundred illuminations. The batteries in the bat are replaceable and are designed to provide twenty-four-hundred illuminations.

The bat lights up when struck, on the ball or against any other surface, and stays lit for the aforementioned thirty seconds and then it shuts itself off. The bat's circuitry also includes a retrigger function like that of the ball, to cause the bat to remain lit so long as it is re-struck within the thirty seconds. This retrigger would then restart the light cycle timer.

The light-up ball and bat allows the user to play baseball related games when during the evening or at other times and in other places that ambient light is low; such as dawn, dusk, night, indoors. Some of the games you can play include: baseball, softball, In-the-Middle, Five Hundred, Easy-Out, Homerun Derby, T-ball, etc.

Baseball is such a well known game that it need not be described here. Softball is a well known variation of baseball. The disclosed bat and ball set enable nighttime play of these games and improved daytime play by increasing the visibility of the ball, such as when a runner is being tagged. The impact of the ball against the glove of a catching player or against the bat, to light the ball, occurs frequently enough to oftentimes keep the ball continuously lit throughout the game, which improves visibility for the umpire to call balls and strikes and for fielders to field the ball after it is hit.

In-the-Middle (also known as "Hot Box") is a baseball drill or mini-game that can be played with three or more players and two to four bases. In the drill, one fielder plays near each of the bases and the rest of the players are runners, who begin on any base. The fielders proceed to throw the ball to each other, playing catch. At any time, a runner may attempt to run to the next or previous base. The fielders then attempt to throw to each other and tag that runner out. If a runner is tagged out (either once or three times), he then becomes a fielder, and the fielder who tagged him out becomes a runner. Runners count how many bases they reach base safely, and the player with the most bases when the group decides to quit, wins. If there are three or more bases, the runners many run in either direction. The impact of the ball against the glove or hand of a catching fielder is sufficient to retrigger the core ball and keep the ball lit through the game, enabling nighttime play. The improved visibility of the lit ball over traditional unlit balls improves the certainty that a runner has or has not been tagged.

In Five Hundred, one player bats the ball and the other players spread out in the field. If a person catches a ball before it hits the ground he scores one-hundred points. If he catches it on one bounce he scores fifty points. All other grounders are twenty-five. No points are earned if the ball rolls to a stop or if the catch is missed. The first player to get five hundred points then gets a turn at bat. The improved visibility of the lit ball over traditional unlit balls improves the ability of the batter to hit the ball and of the fielders to catch the ball.

In Easy-Out, each player is first assigned a number (i.e. from one to ten). Players use the number as their place in the batting order. Since batters are called to bat according to their number, there are never more than four players on offense at once (i.e. a batter and three base runners would be the maximum). Players can play any position on the field, and they rotate as players leave the field to bat. The catcher is typically the on-deck batter. The improved visibility of the lit ball over traditional unlit balls improves the ability of the batter to hit the ball and of the fielders to catch the ball.

Within whatever of the various games the ball and bat are to be used, the sensitivity of the bat and/or ball's electronics may be customized for use to add an additional element to a variety of games. For instance, the inertia switch may be such that it requires greater force to close, thereby only illuminating the bat and/or ball when the bat strikes the ball. Or the switch may be more sensitive so that catching and throwing initiate illumination. Or it may be made even more sensitive so that virtually any movement lights the bat and/or ball. An infinite amount of adjustability to the sensitivity of the inertia switch is available at manufacture to allow an infinite number of possible variations of the set according to the games for which the set is tended to be used, so that one set can be marketed for use in one type of game and a differently manufactured set may be sold for use in a different type of game.

The timers may also be used to add an additional element to any game that was previously unavailable. For instance, the timer may be used to measure time at bat, time running bases, time between pitches, etc. A player may be obligated to reach base or home plate before the ball goes dim, or the fielders may be obligated to tag a runner out before the ball goes dim. An infinite amount of adjustability to the pre-programmed timers is available at manufacture to allow an infinite number of possible illumination times according to the games for which the set is tended to be used, so that one set can be marketed for use in one type of game and a differently manufactured set may be sold for use in a different type of game.

In addition to all of the baseball-based games mentioned and the ball and bat set described, the invention may be practiced as or with numerous other game devices or sets, such as street hockey, ice hockey, field hockey, Hi-Li Scoop, juggling, Kick-the-Can, etc. Any game in which an object, such as a ball or puck, is impacted or caught is a perfect candidate for improvement by the invention.

An additional beneficial feature of the disclosed ball, adaptable to other alternative embodiments, lies in the way that the inner ball bounces loosely around within a hollow outer shell during use. This not only allows lighting of the ball by shaking, but ensures that the ball will be lit by any reasonable impact from any direction. In comparison to the prior art golf balls of similar construction to the inner ball taught by U.S. Pat. Nos. 6,712,487 and 7,785,215, ball 104 removes the inherent element of directionality of those golf balls.

Referring back to FIG. 11 and to the '487 and '215 patents, it can be appreciated that due to the linear configuration of the inertia switches, a strike, such as by a golf club, along the axis of the switch, would be less likely to close the switch than a strike perpendicular to that axis. While this is detrimental in use of the construction in the golf balls of the '215 and '487 patents, the use of such construction as an inner ball as in ball 104 removes that detrimental element of directionality by ensuring that the inner ball bouncing around within the outer shell is going to result in a perpendicular impact upon at least one of the many contacts it makes with the outer shell.

The electronic modules are light enough that they do not adversely affect the performance of the ball or bat, but may be intentionally made heavier, such as to provide a "wobble" effect when the ball is in mid-air, which may provide advantages and challenges that traditional balls do not.

The potting of the ball's electronics permanently and solidly within the core enables the electronics to survive even the most violent impacts. The ball floats, and is water proof.

While the invention has been shown and described with reference to specific exemplary embodiments, it should be understood by those skilled in the art that various changes in form and detail may be made without departing from the spirit and scope of the invention, and that the invention should therefore only be limited according to the following claims, including all equivalent interpretation to which they are entitled.

I claim:

1. A game-playing set comprising a striking device and a ball:

the ball comprising a hollow spherical translucent outer shell and a smaller inner object loosely disposed within the outer shell;

the inner object comprising a first illumination element and a first inertia switch; and the striking device comprising a hollow translucent tube, a second illumination device rigidly disposed within the tube, and a second inertia switch;

wherein the first inertia switch is triggered by impact of the inner object against the outer shell to cause illumination of the first illumination element and thereby cause illumination of and through the hollow spherical translucent outer shell; and the second inertia switch is triggered by an externally-applied impact against the tube to cause illumination of the second illumination element and thereby cause illumination of and through substantially the entirety of the hollow translucent tube.

2. The game playing set of claim 1 wherein the outer shell comprises a plurality of through-holes spaced substantially equally there-around, each enabling direct view through the outer shell to the inner object.

3. The game playing set of claim 1 wherein the tube comprises a tubular wall having a wall thickness that tapers from more thick adjacent the second illumination device to less thick away there-from.

4. The game playing set of claim 3 wherein the wall thickness tapering is continuous.

5. The game playing set of claim 3 wherein the tube tapers from a smaller diameter adjacent the second illumination device to a larger diameter away there-from.

6. The game playing set of claim 5 wherein the tube tapering is continuous.

7. The game playing set of claim 1 wherein the tube tapers from a smaller diameter adjacent the second illumination device to a larger diameter away there-from.

8. The game playing set of claim 7 wherein the tube tapering is continuous.

9. The game playing set of claim 1 wherein the striking device further comprises an opaque tubular grip surrounding the second inertia switch.

* * * * *